US005782496A

United States Patent [19]

Casper et al.

[11] Patent Number: 5,782,496

[45] Date of Patent: Jul. 21, 1998

[54] LINERLESS LABEL IDENTIFICATION

[75] Inventors: Mark S. Casper, Williamsville; John R. Soltysiak, Blasdell; John C. Bane, Grand Island; Michael C. Maier, East Amherst, all of N.Y.

[73] Assignee: Moore Business Forms, Inc., Grand Island, N.Y.

[21] Appl. No.: 552,569

[22] Filed: Nov. 3, 1995

[51] Int. Cl.[6] ..... B42D 15/00

[52] U.S. Cl. ..... 283/81; 283/74; 283/79; 283/101; 428/43

[58] Field of Search ..... 283/81, 101, 74, 283/79, 100, 61, 62; 281/2, 5; 40/299, 310, 630; 428/42.1, 43

[56] References Cited

U.S. PATENT DOCUMENTS

| | | |
|---|---|---|
| 4,460,634 | 7/1984 | Hasegawa . |
| 4,768,810 | 9/1988 | Mertens . |
| 4,798,401 | 1/1989 | Greig . |
| 4,889,234 | 12/1989 | Sorensen et al. . |
| 5,011,186 | 4/1991 | Bodziak et al. . |
| 5,201,464 | 4/1993 | File . |
| 5,283,221 | 2/1994 | Inobe . |
| 5,324,078 | 6/1994 | Bane . |
| 5,336,541 | 8/1994 | Kobayashi . |
| 5,370,916 | 12/1994 | Olsen . |

FOREIGN PATENT DOCUMENTS 0 512 153 A2 11/1992 European Pat. Off. .

*Primary Examiner*—Frances Han

*Attorney, Agent, or Firm*—Nixon & Vanderhye, P.C.

[57] ABSTRACT

Labels are provided with sequential numbers which are important in a number of different applications including whether or not there are enough labels left on a roll to perform various operations on the roll. Linerless labels in a spiral roll include an innermost label and an outermost label. Each label includes a substrate with an inner face primarily coated with pressure sensitive adhesive and an outer face coated with release material. The sequential numbers are typically unobtrusive, and are applied to one or both of the inner and outer faces, preferably on the substrate before the coatings are applied. Desirably the innermost label contains the lowest number (typically zero or one) and the outermost the highest. Various pattern coatings can be applied to the substrate, particularly for the adhesive, depending upon the particular application, including at the interface between labels to make them easier to cut at the interface without the blade sticking to adhesive. The sequential numbers may be provided at the non-adhesive interface, or on non-adhesive portions of separable side strips along the labels. A roll of conventional lined labels may be unwound, sequential numbers applied to the adhesive side, and wound up in a roll again. In the printing of labels to be used on pharmaceuticals, thermally sensitive labels may be used and a scanner under computer control used to verify the correctness of the numbers and other pharmaceutical indicia printed.

22 Claims, 5 Drawing Sheets

LINERLESS LABEL IDENTIFICATION

BACKGROUND AND SUMMARY OF THE INVENTION

Many roll label users (especially pharmaceutical manufacturers and people utilizing automatic applicators) need to know how many labels are left on a roll after a run. For example, this lets the user decide if a roll has enough labels for another production run. There are also many other circumstances in which numbering on labels would be useful, but sequential numbering of labels for the purpose of determining the number of labels on a roll is not offered by commercial label manufacturers.

In the construction of linerless labels it is sometimes desirable to provide various pattern coats of adhesive for a wide variety of different purposes. However, heretofore pattern coating of adhesive has not been applied as diversely as might be expected giving its utility for a wide variety of different label applications.

According to the present invention, various constructions of labels, and methods of the production thereof, are provided which effectively utilize sequential numbering of labels particularly starting with zero or one at the label core and increasing to the outermost label, such labeling being highly desirable where for various purposes it is useful to know how many labels are left in a roll. An unobtrusive sequential number is applied, e.g. at an unobtrusive location or of unobtrusive material, on the label since it is not indicia that the ultimate user of the label requires, and in fact is desirably applied on a portion of the label that is hidden or removed once or before the label is applied to a surface during use. Also, according to the present invention, various pattern coating structures and procedures are utilized in order to facilitate maximum utility of the labels including facilitating effective sequential numbering thereof. The invention also relates to specialty applications for labels and special processes for the production of labels such as for pharmaceuticals.

According to one aspect of the present invention, a roll of linerless labels is provided including the following components: A trailing innermost label in a spiral roll, and a leading, outermost label in the spiral roll. Each label including a substrate having an inner face primarily coated with pressure sensitive adhesive, and an outer face coated with release material. And unobtrusive sequential numbers applied to one or both of the inner and outer faces of the labels.

Typically the trailing innermost label has the lowest of the sequential numbers (preferably zero or one) and the leading, outermost label has the highest of the sequential numbers. The sequential numbers may be applied directly to the substrate, and then overcoated with the adhesive or release material, or applied to adhesive-free (or adhesive portions rendered non-tacky) of pattern coated or other specially constructed or treated labels. Alternatively, the numbers can be printed directly over the adhesive itself, without the need to detackify the adhesive or pattern coat the adhesive area. Applying the numbers directly to the substrate and overcoated, however, provides a security function, minimizing the possibility of undetected tampering with the label numbers, which can be important in certain circumstances such as where the labels are used in the manufacture or distribution of pharmaceuticals. Applying the labels either on or under the adhesive coat is particularly desirable since it is more unobtrusive than an outer face (which will be seen after the label is applied). In one particularly desirable pattern, adhesive is not applied at the interface between adjacent labels, which not only allows an area for ready application of a sequential number, but also facilitates separation of the labels since cutting instruments to effect separation will not become covered with adhesive. The numbers may be in human readable form, machine readable form (for example bar coding), or both.

The adhesive coat can also be applied in a pattern such that one or more side strips are provided which extend longitudinally along the labels (and may be separated from the adhesive coated portions of the labels by perforations or other lines of weakness), and the sequential numbering may be provided on a side strip so that after full printing of the labels the side strip can be readily detached so that the sequential number is not visible at all on the final label although visible on the typically indicia-receiving face of the label during production. The face of the side strip opposite the numbering may be coated with transfer tape so that when the side strip is removed from the label and the release sheet on the transfer tape is removed the side strip can be applied to a record book or the like. The use of transfer tape is typically found in only small to medium batches as the additional thickness of the transfer tape creates an unbalanced roll of material. In most linerless label constructions, and particularly large batches, no transfer tape is used.

For specialty application various other patterns may be provided. For example, each label may include the adhesive coat applied in a pattern so that there is at least one intermediate area of the label inner face that is free of adhesive. This intermediate area is preferably slightly longer than the circumference of a coat hanger hook, or twice the width of a belt loop of a pair of pants, or twice the width of the fabric between a shirt buttonhole and the edge of the shirt adjacent the buttonhole. In these situations the numbering is on the outer face since the labels will be wrapped around the hanger, pants loop, or a width of cloth adjacent the buttonhole and the ends adhesively secured to each other while no adhesive engages the hanger or cloth. The numbering in such circumstances is desirably bar coding which facilitates automated handling of the hangers and clothing thereon or dry cleaned pants or shirts.

According to another aspect of the present invention a roll of lined labels is provided comprising the following components: A trailing innermost, label in a spiral roll, and a leading, outermost, label in the spiral roll. Each label including a substrate having an inner face primarily coated with pressure sensitive adhesive and covered with a release liner, and an outer face adapted to receive indicia. And sequential numbers applied to the inner faces of the labels, the trailing, innermost label having the lowest of the sequential numbers and the leading outermost label the highest.

The number may be applied directly to the substrate, underneath the adhesive coat, or applied on top of the adhesive coat (e.g. with ink jet or similar non-impact printers). The number sequences and starting point are preferably as described above with respect to the linerless labels.

According to still another aspect of the present invention a method of processing thermal pharmaceutical labels is provided, comprising the steps of sequentially: (a) Applying color, non-variable indicia to a first face of labels and pressure sensitive adhesive to a second face, to form a roll of non-variable indicia printed labels. (b) Transporting the roll to a user's site. (c) Under computer control, thermally imaging variable indicia, including numerical indicia and pharmaceutical indicia on the labels at the user's site. (d)

Under computer control, scanning the applied variable indicia and checking the accuracy thereof. And (e) applying the labels from step (d) to pharmaceutical containers.

Various other constructions and procedures may be implemented pursuant to the invention, such as providing an array of squares or rectangles printed in a pattern coat with adhesive on a linerless label, allowing slitting or detaching utilizing conventional equipment without the equipment having to engage an adhesive, yet allowing the ease and inexpensiveness of manufacture of the labels with a common width (that is providing versatility to the user in the width and length of label selected, while still accommodating the needs of the label producer).

It is a primary object of the present invention to provide desirable numbering and pattern coating for labels, particularly linerless labels. This and other objects of the invention will become clear from an inspection of the detailed description of the invention, and from the appended claims.

DETAILED DESCRIPTION OF THE DRAWINGS

Figure 1:
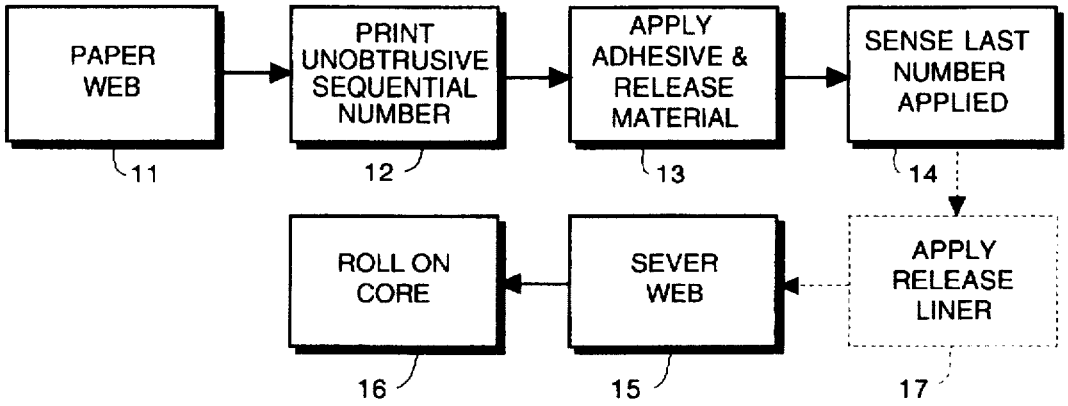
FIG. 1 is a schematic diagram illustrating exemplary method steps for the production of sequentially numbered labels according to the invention.

FIG. 1 schematically illustrates an exemplary method according to the present invention. A paper web 11, or other substrate, is printed with a sequential (typically the numbers only one apart) number as indicated at 12 in FIG. 1. Printing may be by any conventional impact or non-impact printing technique compatible with the web 11. The sequential number is unobtrusive, either in character, location, or both. For example, it may be an unobtrusive location if positioned on a part of the label that will not be seen when the label is used, or it may be unobtrusive in construction because it is printed in an ink that would not normally and/or easily be seen by the user or viewer of the label (e.g. in a light, invisible except when exposed to certain electromagnetic radiation, or complementary colored ink).

After printing of the sequential number at 12 on the web 11, adhesive is applied to one face of the web and a release coat to the other face of the web as illustrated schematically at 13, the exact order of application of the adhesive and the release coat not normally being critical. The printing may be applied after the adhesive has been coated on the substrate 11. Typically, when the last number applied at 12 for application for a particular roll was applied that would be independently sensed as indicated at box 14 (which could be made redundant with a counting mechanism associated with the sequential number printer 12), at which point the web could be severed as indicated at 15 in FIG. 1. The web of labels, with the sequential numbers thereon, is rolled on a core or the like as indicated at 16, typically with the lowest number (in most applications zero or one) closest to the core and the highest number the outermost, leading label of the roll.

While FIG. 1 illustrates a particular sequence, it is to be understood that many variations of the sequence are practical. For example, the order of steps 12, 13 may be reversed.

While the solid line boxes in FIG. 1 illustrate a method according to the invention for making linerless labels, the method also can be utilized to make linered labels. In this situation the release coat is not applied at stage 13, and instead a release liner is applied, as indicated schematically by box 17 in FIG. 1.

Figure 2:
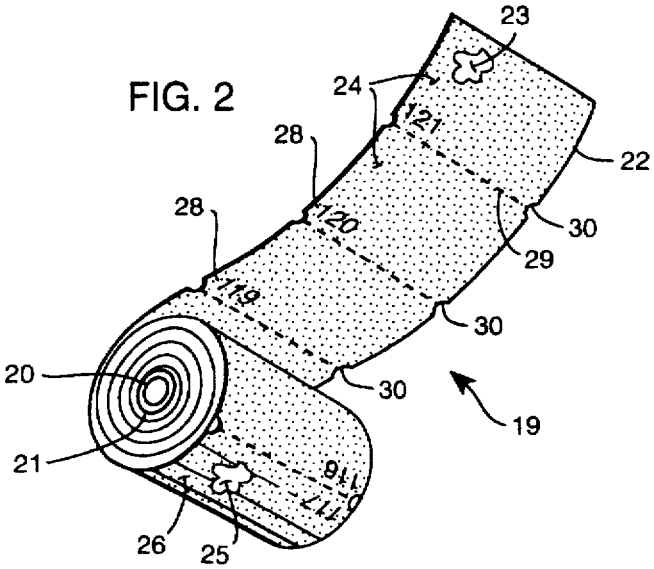
FIG. 2 is a bottom perspective view of a roll of partially unwound linerless labels according to the present invention.

FIG. 2 illustrates an exemplary roll of linerless labels according to the present invention, the roll shown generally by reference numeral 19. The roll 19 is shown having a core 20, in this case the core 20 of a separate structure (e.g. a tube of cardboard or plastic). The roll 19 includes an innermost label shown schematically at 21, which is the trailing label as the roll 19 is unwound, and a leading, outermost label shown at 22 in FIG. 2. Each of the labels (as shown for the label 22 in FIG. 2) includes an inner face 23 coated with pressure sensitive adhesive 24 (either removable or permanent, typically permanent), and an outer face (shown at 25 in FIG. 2) coated with the adhesive release material 26 (e.g. a silicone material that will not adhere to the adhesive 24). In this case the unobtrusive sequential numbers are indicated at 28, the highest number being on the label 22 (the number 121 in the embodiment illustrated), while the lowest number (typically zero or one) being on the innermost label 21.

In FIG. 2 perforation lines 29 (or other lines of weakness) are shown separating the labels from each other, and U-shaped or V-shaped cutouts 30 are illustrated along the edges at the perforations 29 to facilitate separation of the labels during automatic dispensing or the like, such perforations 29 in cutouts 30 being known per se, such as shown in co-pending application Ser. No. 08/321,025, filed Oct. 6, 1994. Sense marks might also be printed on the substrate, so that a sensor can activate a rotary cutter, or anvil and blade, to cut the labels from the web.

Figure 3:
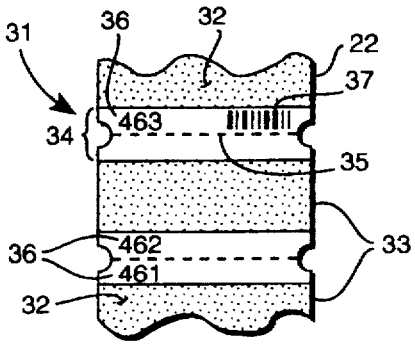
FIG. 3 is a bottom plan view of part of a roll of linerless labels according to another embodiment of the invention.

FIG. 3 illustrates another embodiment of a roll of labels according to the invention, shown schematically at 31. In this embodiment pattern coating of adhesive 32 is applied to the substrate forming each of the labels 33, leaving an adhesive-free area 34 at the interface between adjacent labels 33. Perforation lines 35 may also be provided at the interface. The unobtrusive sequential numbers 36 in human readable form are imaged on this adhesive-free portion 34.

Machine readable (e.g. bar code) versions of the numbers, such as illustrated at 37, may be provided in addition to the human readable numbers 36 or in place thereof. FIG. 3 illustrates two different manners in which the numbers can be applied, the number "463" being shown spaced from the number "462" the length of a label 33, while the numbers "462, 461" on opposite sides of the perforation line 45 between their adjacent labels 33. In this embodiment—as in the FIG. 2 embodiment with the numbers 28 provided on the inner face 23—it is the location of the sequential numbers that makes them unobtrusive, although the particular ink color or visibility may also make them unobtrusive. Note that the provision of the adhesive-free area 34 at the perforation line 35 also has another advantage. The cutting or other severing mechanisms that are used to assist in severing the labels 33 from each other along the perforation line 35 (or at the interface even if there are no perforations 35) will engage non-adhesive portions of the labels 33, and thus will not become contaminated with adhesive and, therefore, have longer life between shutdowns.

Figure 4:
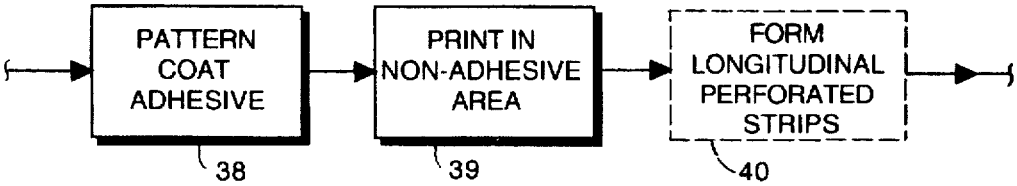
FIG. 4 is a schematic diagram illustrating method steps used in the production of the labels of FIG. 3.

FIG. 4 schematically illustrates a slightly different sequence of steps for the general procedure of FIG. 1 to produce the roll 31 of FIG. 3. In place of the steps 12, 13 as illustrated in FIG. 1, the pattern coat of adhesive 38 is first practiced with printing in the non-adhesive area (34) then talking place as illustrated schematically at 39 in FIG. 4, with the optional step of forming longitudinal perf strips (as will be described with respect to the FIGS. 5 and 6 embodiments) being schematically illustrated at 40. After box 39 (or 40 if used) the release coat aspect of the box 13 is practiced, with the rest of steps the same as in FIG. 1.

Figure 5:
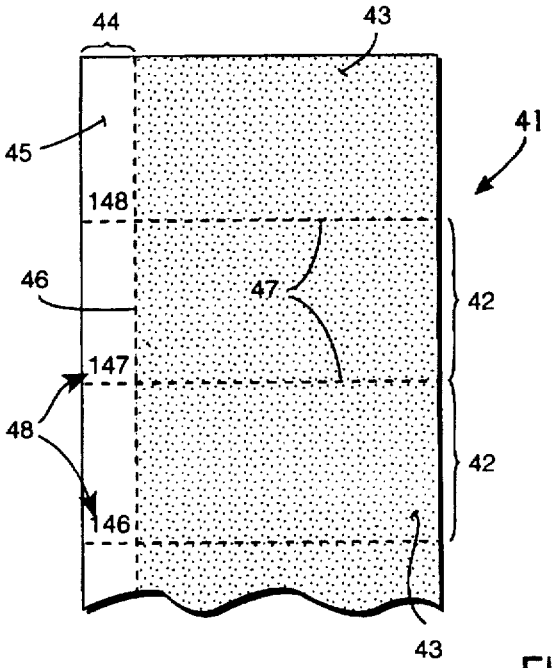
FIG. 5 is a view like that of FIG. 3 of another embodiment.

FIG. 5 illustrates another modification of a roll of labels 41 according to the invention in which pattern coating is provided. In this particular case for the labels 42 of the roll 41 the adhesive 43 is pattern coated such that the surface 45 of one or more longitudinal strips 44 are free of adhesive. The unobtrusive sequential numbers 48 are then printed on face 45 of the strip 44, again perforation lines 47 preferably being provided separating the labels 42 from each other in the transverse dimension, while optionally but preferably a longitudinal perf line 46 (made pursuant to the block 40 in FIG. 4) is provided between the pattern coated adhesive 43 and the adhesive-free surface 45. In this way the numbers 48—which may be printed either before or after the adhesive 43 is applied—are particularly unobtrusive because they will be removed, by detachment of the perforation 46, in some further processing stage.

Figure 6:
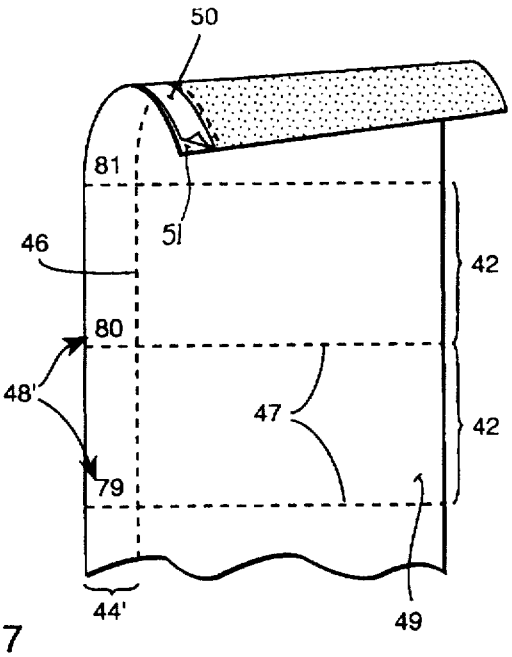
FIG. 6 is a top view of yet another embodiment with a portion turned back to illustrate the bottom thereof.

FIG. 6 illustrates another embodiment, components in the FIG. 6 embodiment the same as those in the FIG. 5 embodiment being shown by the same reference numeral, and where variations are minor by a "prime". In this embodiment the numbers 48' are printed on the release coated face 49 of the label (or the release coat may also be pattern coated so that it does not go into the longitudinal strip 44'). The sequential numbers 48' are unobtrusive because they are in the portion 44' which will be removed. In this embodiment in order to keep a record of what labels have been dispensed, when, a piece of transfer tape may be applied to the opposite face of the longitudinal strip 44' from the numbers 48', the release sheet portion of the transfer tape being shown by reference number 50 in FIG. 6, and the adhesive thereof (which stays on the label 42 longitudinal strip 44' when the release sheet 50 is removed) being shown at 51. The use of transfer tape is typically found in only small to medium batches as the additional thickness of the transfer tape creates an unbalanced roll of material. In most linerless label constructions, and particularly in large batches no transfer tape is used.

Figure 7:
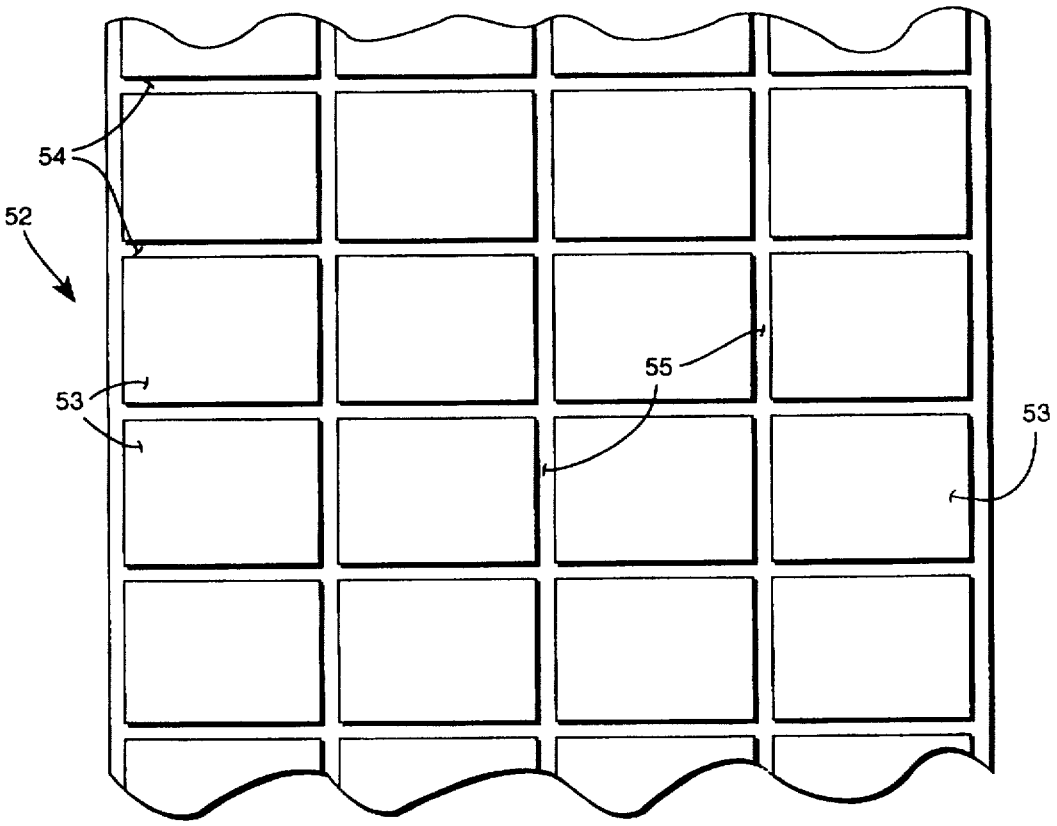
FIG. 7 is a bottom plan view of an adhesive pattern coated embodiment of linerless labels according to the invention.

FIG. 7 illustrates another form of pattern coated label 52, in this case the adhesive patterns 53 comprising a square or rectangular wave pattern across the label 52 web, with the width between adhesive areas being shown by reference numeral 55 and the length spacing therebetween being shown by reference numeral 54, with the predetermined pattern repeat length (as illustrated in FIG. 7) typically provided. Perforation lines separating individual labels are not shown in FIG. 7, but may be provided where desired. The construction in FIG. 7 is particularly desirable because this would allow the label manufacturer to inexpensively manufacture the labels since only one width label would be manufactured, which then could be slit or otherwise cut for the end user, or by the end user, into other desired widths, and any desired lengths of labels, merely by severing along the spacings 54, 55. Such severing would take place in non-adhesive areas thereby extending the length of the time the cutters could be used before cleaning.

Particularly with respect to the FIG. 7 embodiment, but also in other pattern coating of pressure sensitive adhesive on linerless labels, the following specifications may be utilized (all values are approximate): Hot melt permanent adhesive (e.g. Kraton based, application temperature 325 degrees Fahrenheit, 10,000 centipoise viscosity), or aqueous permanent adhesive (acrylic based emulsion adhesive, 50% solids, 500 centipoise viscosity) applied with an adhesive dry coat weight of 4.0 to 5.0 pounds per 1300 square feet (caliper approximately 0.0006 to 0.0008") and an adhesive dry coat weight tolerance of +/− 10% across and along the web. Preferred substrates include 26 pound bond paper (17×22" ream), 30–50 pound silicone coat release paper (24×36" ream), and film: polyester or polypropylene film (e.g. 0.001" thick). Maximum web widths are typically 16" (narrow web transport) or 30" (wide web transport); and run speed is 40 to 500 fpm, while web tension is 0.5 to 3.0 pounds per linear inch of web width. For the rectangular adhesive pattern of FIG. 7, size is typically: width (across web): 0.25" to maximum web width less 0.25"; length (along web): 0.25" to 23.75"; plus continuous, with an adhesive pattern size tolerance of +/− 1/64" on each side. The distance between adhesive areas is: width (across web): 0.125" to maximum web width less 0.75"; length (along web): 0.125" to 23.25". Pattern registration is: +/− 1/64" across and along the web (geared processes typically hold this tolerance), and pattern repeat lengths: 9" to 24" in 0.125" increments.

Figure 9:
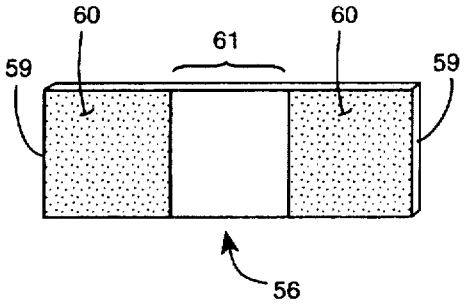
FIG. 9 is a bottom plan view of the label used in FIG. 9.
Figure 8:
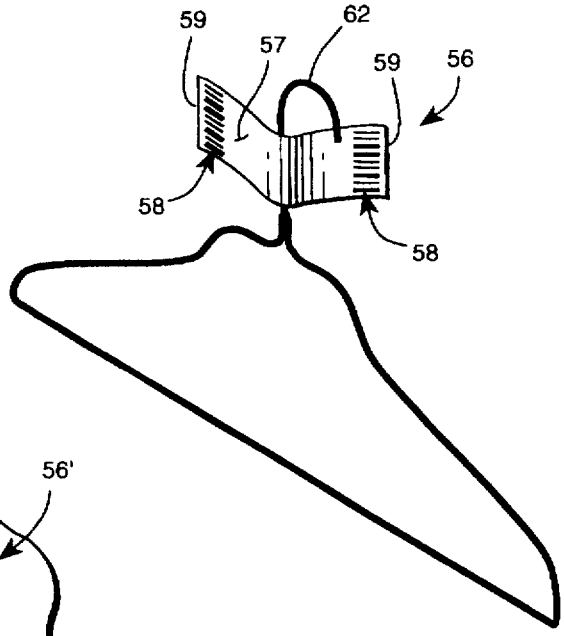
FIG. 8 is a top perspective view schematically illustrating use of an exemplary pattern coated label according to the invention with a clothes hanger.

FIGS. 8 and 9 illustrate another form of pattern coated label, shown generally by reference numeral 56, that can have a particular use in the dry cleaning or hanger manufacturing trade, for example. In this embodiment the applied numbers may or may not be obtrusive. In this case the label 56 has a first surface 57 on which sequential numbering 58 is printed, in this case in machine readable form, for example adjacent the ends 59 thereof. On the back of label 56—as seen in FIG. 9—adhesive 60 is provided in pattern coats, being provided adjacent the ends 59 of the label 56, but leaving an adhesive free area 61 between the pattern coat 60. The adhesive free area 61 has a length (the dimension between the ends 59) that is slightly larger than the diameter of a hook 62 of a conventional clothes hanger, or another part (typically wire) of the clothes hanger if used thereon, such that the label 56 may be wrapped around the clothes hanger (e.g. hook 62) with the pressure sensitive adhesive pattern 60 of the label 56 brought into holding contact with each other, while the adhesive free area 61 engages the hanger (e.g. hook 62) so that no adhesive is on the hanger itself.

Figure 10:
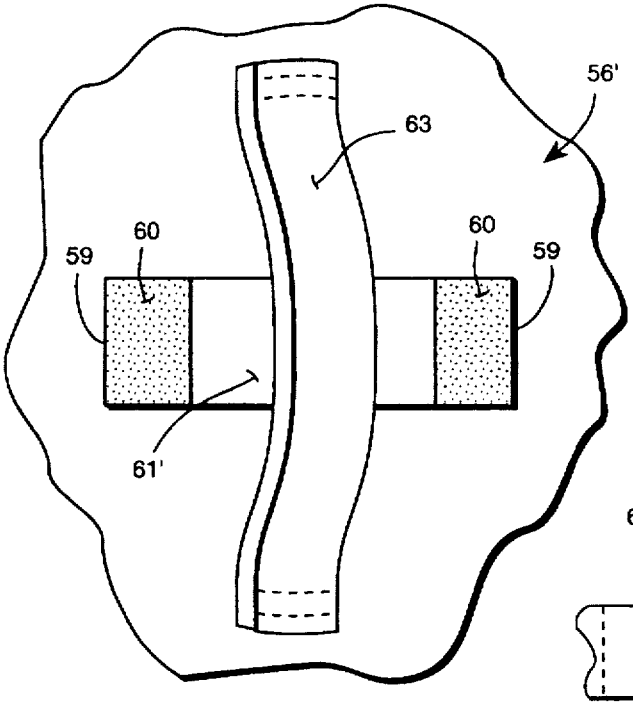
FIG. 10 is a label like that of FIG. 9 used with a belt loop of a pair of pants.

FIG. 10 shows another utilization of a label like the label 56 of FIGS. 8 and 9, in this case the label being shown by reference numeral 56' and components thereof comparable to those in the FIGS. 8 and 9 embodiment being shown by the same reference numeral. In this case the only difference between the label 56' and the label 56 is the length of the non-adhesive portion 61' (between the ends 59), the length 61' being slightly more than twice the width of a belt loop 63 in a pair of pants 64 or other article of clothing. The same label 56', where the length of the non-adhesive portion 61' is appropriately adjusted, may be used to be fastened in a buttonhole of a shirt, the length of the non-adhesive portion 61' then being slightly more than twice the width between the buttonhole and the edge of the cloth of the shirt on which the buttonhole is formed. Either human readable or machine readable indicia, or both, like indicia 58 illustrated in FIG. 8, are on the opposite face of the label 56' from that seen in FIG. 10.

Other speciality uses—besides those illustrated in FIGS. 8 through 10—of labels according to the invention are in the jewelers industry, where rings, watches, necklaces and the like are wrapped with a label which has an adhesive free area so that no adhesive comes into contact with the jewelry; or as a bottle closure or security seal, wherein the perforation line is between the cap and neck of the bottle so that when opened part of the label stays on the neck and part stays with the cap.

Figure 11:
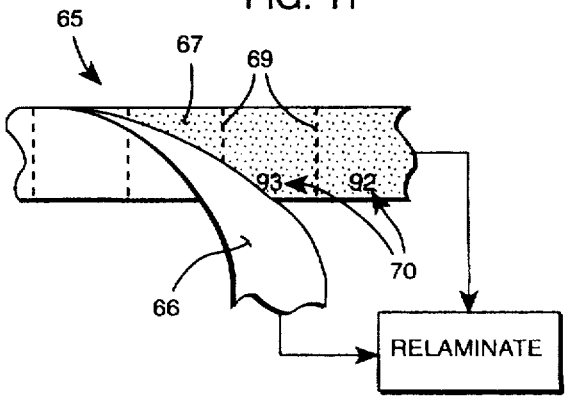
FIG. 11 is a schematic view showing de-lamination, number printing, and re-lamination of a roll of lined labels.
Figure 12:
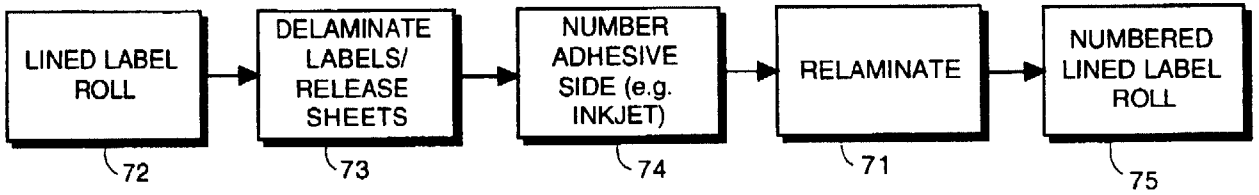
FIG. 12 is a block diagram illustrating the method of FIG. 11.

FIGS. 11 and 12 illustrate another schematic structure and method according to the present invention. In this case, as seen in FIG. 11, a roll of lined labels 65 comprising a release liner 66 on a label strip 67 is de-laminated, printed, and then laminated again. The release liner 66 covers the adhesive face 68 of the label web 67, with perforation lines 69 typically being provided. After the release liner 66 is removed, the sequential numbers 70 are printed directly on the adhesive 68 with a suitable non-impact printer, such as an ink jet printer. After the numbers 70 are printed and appropriately dried, cured or set (if needed)—the release liner 66 is moved back into contact with the adhesive face 68, this re-lamination stage being illustrated schematically at 71 in FIG. 12. The numbers 70 will be printed so that, in a simplest embodiment, the first label from the roll 65 taken off will be printed with number zero or one, and that label will be taken up on another roll, with the numbers thus going up from the first printed label on the new roll.

FIG. 12 schematically illustrates a method utilized to form the sequentially numbered lined label roll from what previously exists such as seen in FIG. 11. The lined label roll 72 is de-laminated utilizing any suitable rollers, knife blades, and/or other conveyance structures as illustrated at 73, the sequential numbers 70 are ink jet printed, or printed using UV curable ink, or the like as indicated at 74, and then re-laminated as indicated at 71 in both FIGS. 11 and 12 again utilizing any suitable rollers and conveyance mechanisms, with the numbered lined label roll produced at 75.

Figure 13:
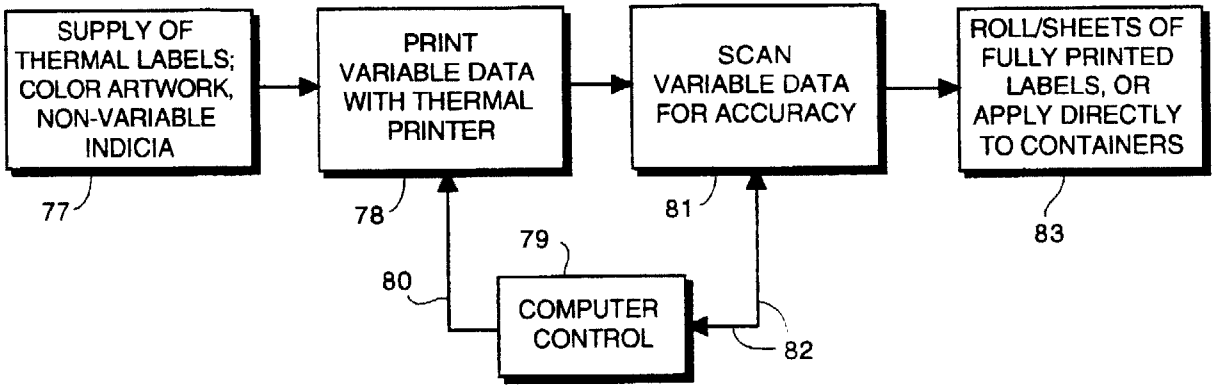
FIG. 13 is a block diagram showing a method of labeling pharmaceuticals according to the invention.

FIG. 13 illustrates schematically another exemplary method that may be practiced according to the present invention, particularly suitable for pharmaceutical labeling. Pharmaceutical labelers typically buy many pre-printed labels (which tend to be short run and expensive) and then run as many labels as needed, the others oftentimes being wasted rather than fully utilized. FDA good manufacturing practices regulations compel manufacturers to keep records confirming how many labels are purchased and used because of the nature of the pharmaceuticals that are packaged with the labels, so that the labels can be accounted for to insure that there is no theft of prescription drugs or the like.

Instead of supplying a pharmaceutical manufacturer with completely pre-printed labels, according to the invention as schematically illustrated in FIG. 13, high resolution thermal transfer labels are supplied as illustrated at 77 which have the color art work and non-variable indicia printed thereon. The black product-specific information is left off, however. This variable data is then printed as indicated at 78 with a thermal printer (of a high resolution thermal transfer type in the preferred embodiment), including the product specific information. The printing 78 is preferably done under the control of a computer 79, the control pathway being illustrated at 80 in FIG. 13. Then, in order to insure accuracy because of the nature of the product being labeled, preferably the method includes the step 81 of scanning the variable indicia printed at step 78 for accuracy. In the scanning stage 81, the variably imaged indicia imprinted on the label is digitized, and again through the computer control as indicated by lines 82 in FIG. 13, the accuracy of the data is checked and a suitable alarm or work stoppage effected if a discrepancy is recognized. Image verification software is typically supplied to the computer control 79 along with the label supply, and this allows a 100% quality control to guarantee the labels are properly produced.

After appropriate quality control at box 81, as illustrated schematically at 83 in FIG. 13, the labels may be formed in rolls or sheets of fully printed labels or—preferably—they are applied directly to the containers containing the pharmaceuticals.

Figure 14:
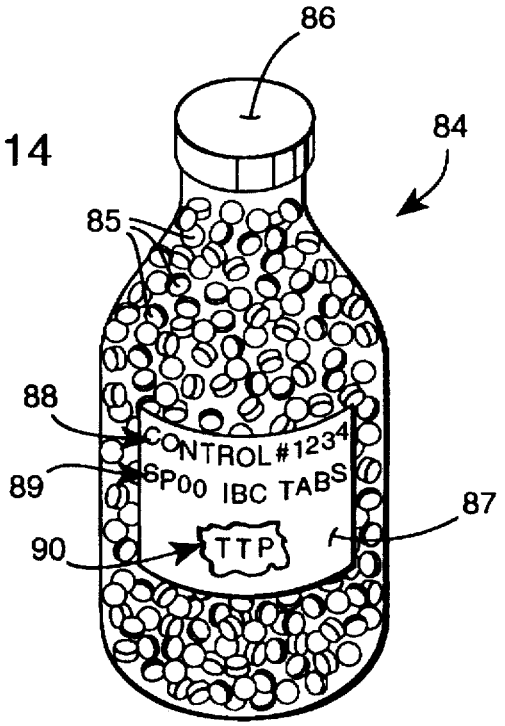
FIG. 14 is a top perspective view of a pharmaceutical container labeled according to the method of FIG. 13.

FIG. 14 shows the end result of a product produced utilizing the method of FIG. 13. A pharmaceutical container 84 (e.g. a bottle) containing the pharmaceuticals 85 (e.g. antibiotic pills or tablets, vitamins, nutritional supplements, barbiturates, etc.) is capped by a cap 86 with a label 87 having a pressure sensitive adhesive face thereof applied to the container 84. The label 87 includes sequential numerical indicia applied at stage 78, as indicated schematically at 88 in FIG. 14, as well as other product specific indicia applied at stage 78, as indicated at 89 in FIG. 14. Color art work and like non-variable indicia, illustrated at 90 in FIG. 14, was applied at 77 when the labels were supplied to the pharmaceutical manufacturer/labeler.

Figure 15:
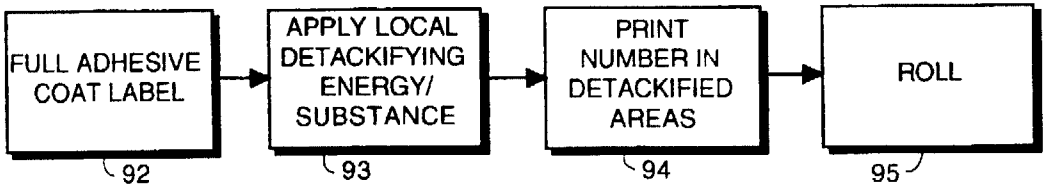
FIG. 15 is a block diagram of another method of linerless label production.

FIG. 15 illustrates schematically yet another embodiment of a method according to the invention. In this embodiment the same general results as obtained by pattern coating are provided except that pattern coating equipment need not be utilized, but rather a mechanism for rendering non-tacky the applied adhesive is utilized.

As illustrated in FIG. 15 a label is full coated with adhesive as indicated at 92. Then a local de-tackifying energy or substance is provided as indicated at 93. For example, corona energy may be used to de-tackify the adhesive at a particular area, or that area could be overcoated with a masking material such as a wax to prevent full exposure of the adhesive until such time as all the adhesive is needed. Sequential numbers may be printed on the de-tackified areas as indicated at 94, or may have been earlier printed (before the adhesive coating 92) especially where the masking material is utilized and will be removed at some later stage. Finally a roll 95 of labels is formed.

It will thus be seen that according to the present invention advantageous products and procedures have been provided particularly for use with linerless labels, but also for linered labels. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent products and procedures.

What is claimed is:

1. A roll of linerless labels including a trailing innermost label in a spiral roll, and a leading, outermost label in the spiral roll;

each label including a substrate having an inner face primarily coated with pressure sensitive adhesive, and an outer face coated with release material; and unobtrusive sequential numbers applied to one or both of said inner and outer faces of said labels.

2. A roll of linerless labels as recited in claim 1 wherein said trailing innermost label has the lowest of said sequential numbers and said leading outermost label has the highest of said sequential numbers.

3. A roll of linerless labels as recited in claim 2 wherein the lowest of said sequential numbers is one or zero.

4. A roll of linerless labels as recited in claim 3 wherein said sequential numbers are applied directly to said substrate, under said adhesive or release coat.

5. A roll of linerless labels as recited in claim 3 wherein said sequential numbers are applied directly to said inner face of said substrate, under said adhesive coat.

6. A roll of linerless labels as recited in claim 3 wherein said sequential numbers are applied over said adhesive coat.

7. A roll of linerless labels as recited in claim 1 wherein each label includes said adhesive coat applied in a pattern so that said inner faces between the interface of adjacent labels are free of adhesive; and wherein said sequential numbers are applied to said inner faces where free of adhesive.

8. A roll of linerless labels as recited in claim 1 wherein said numbers are in human readable form.

9. A roll of linerless labels as recited in claim 1 wherein said numbers are in machine readable form.

10. A roll of fineness labels as recited in claim 1 wherein each label includes said adhesive coat applied in a pattern so that at least one longitudinal side strip free of said adhesive coat is provided, said sequential numbering provided on said inner face in said longitudinal side strip.

11. A roll of linerless labels as recited in claim 10 further comprising a longitudinal line of weakness separating said longitudinal side strip from the rest of said label.

12. A roll of linerless labels as recited in claim 7 further comprising a transverse line of weakness formed at each interface between adjacent labels where free of adhesive.

13. A roll of linerless labels as recited in claim 1 wherein each label includes said adhesive coat applied in a pattern so that at least one longitudinal side strip free of said adhesive coat is provided; and wherein said sequential numbering is applied to said outer faces of said labels in said longitudinal side strip.

14. A roll of linerless labels as recited in claim 13 further comprising longitudinal transfer tape applied to said inner face of said labels at said longitudinal side strip; and further comprising a longitudinal line of weakness separating said longitudinal side strips from the rest of said label.

15. A roll of linerless labels including a trailing innermost label in a spiral roll, and a leading, outermost label in the spiral roll;

each label including a substrate having an inner face primarily coated with pressure sensitive adhesive, and an outer face coated with release material;

sequential machine readable numbers applied to one or both of said inner and outer faces; and wherein said adhesive coat is pattern-coated on said substrate so that an intermediate area of said label inner face is free of adhesive.

16. A roll of linerless labels as recited in claim 15 wherein said intermediate area is slightly larger than the circumference of a wire clothes hanger.

17. A roll of linerless labels as recited in claim 15 wherein said intermediate area of said label inner face is slightly larger than twice the width of a belt loop of a pair of pants or twice the width of cloth between a shirt buttonhole and edge of the shirt adjacent the buttonhole.

18. A roll of linered labels including a trailing innermost, label in a spiral roll, and a leading, outermost, label in the spiral roll;

each label including a substrate having an inner face primarily coated with pressure sensitive adhesive and covered with a release liner, and an outer face adapted to receive indicia; and sequential numbers applied to said inner faces of said labels, said trailing, innermost label having the lowest of said sequential numbers and said leading outermost label the highest.

19. A roll of labels as recited in claim 18 wherein said numbers are applied on top of said adhesive coat.

20. A roll of labels as recited in claim 18 wherein the lowest of said sequential numbers is one or zero, and said numbers are human readable.

21. A roll of labels as recited in claim 19 wherein the lowest of said sequential numbers is one or zero, and said numbers are human readable.

22. A roll of linerless labels as recited in claim 15 wherein said sequential machine readable numbers are applied to said outer faces over said release material.

* * * * *